US005794262A

United States Patent [19]

Capello

[11] Patent Number: 5,794,262

[45] Date of Patent: Aug. 18, 1998

[54] FIRE-PROOF PROTECTIVE WEARING OUTFITS WITH DIFFERENTIATED PERSPIRABILITY

[75] Inventor: Giuseppe Capello, Turin, Italy

[73] Assignee: Prometeo S.p.A., Sommariva del Bosco, Italy

[21] Appl. No.: 757,961

[22] Filed: Nov. 25, 1996

Related U.S. Application Data

[63] Continuation of Ser. No. 311,000, Sep. 22, 1994, abandoned.

[30] Foreign Application Priority Data

Sep. 23, 1996 [IT] Italy ..... T093A0696

[51] Int. Cl.[6] ..... A41D 11/00

[52] U.S. Cl. ..... 2/81; 2/458

[58] Field of Search ..... 2/81, 458, 85, 2/93, 97, 456, DIG. 1

[56] References Cited

U.S. PATENT DOCUMENTS

| | | | |
|---|---|---|---|
| 2,994,089 | 8/1961 | Ferguson, Jr. et al. | 2/81 |
| 3,761,962 | 10/1973 | Myers . | |
| 4,722,099 | 2/1988 | Kratz . | |
| 5,105,478 | 4/1992 | Pyc . | |
| 5,170,506 | 12/1992 | Lewis, Jr. et al. | 2/81 |
| 5,172,426 | 12/1992 | Capello | 2/81 |

*Primary Examiner*—Diana Biefeld

*Attorney, Agent, or Firm*—Sughrue, Mion, Zinn, Macpeak & Seas, PLLC

[57] ABSTRACT

There is described a fire-proof protective outfit for activities involving a risk of burns.

1 Claim, 5 Drawing Sheets

FIG. 1
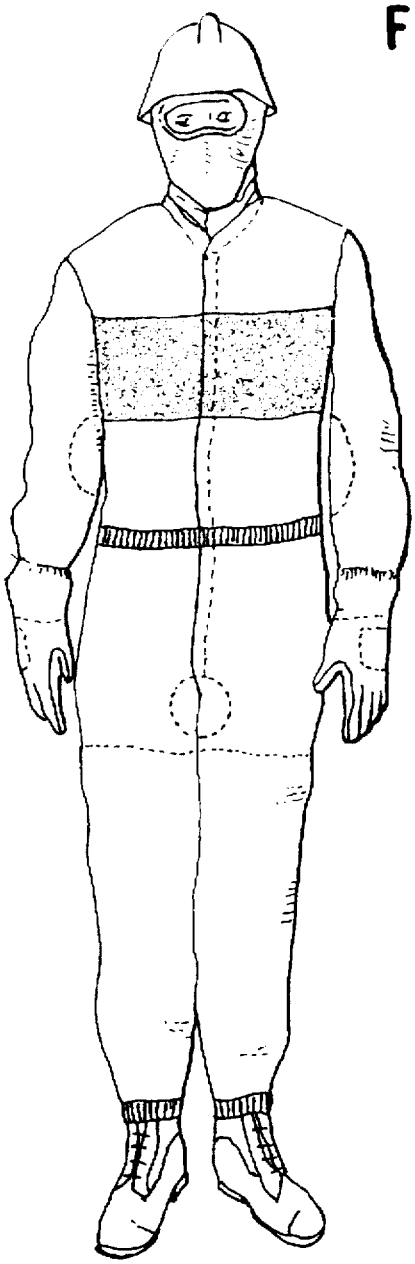
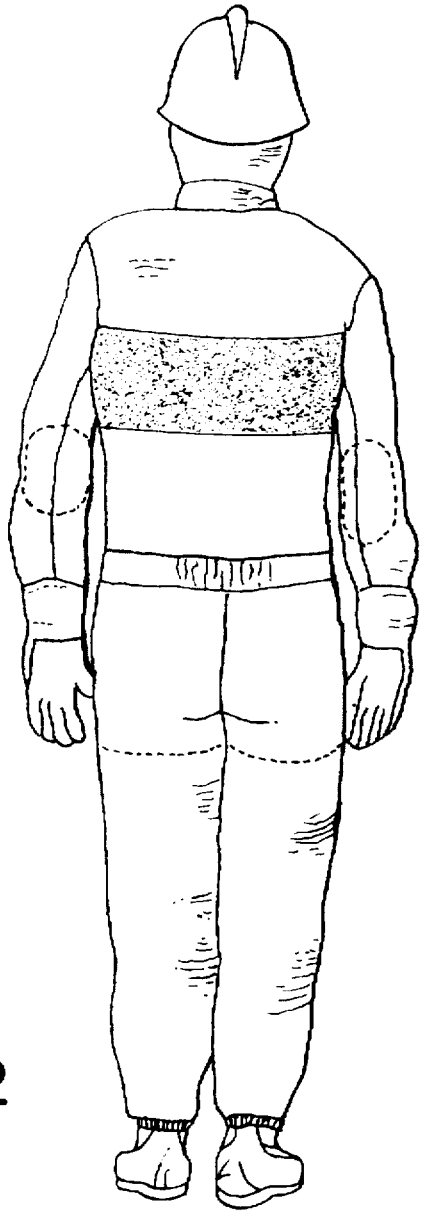
FIG. 2

FIG. 3
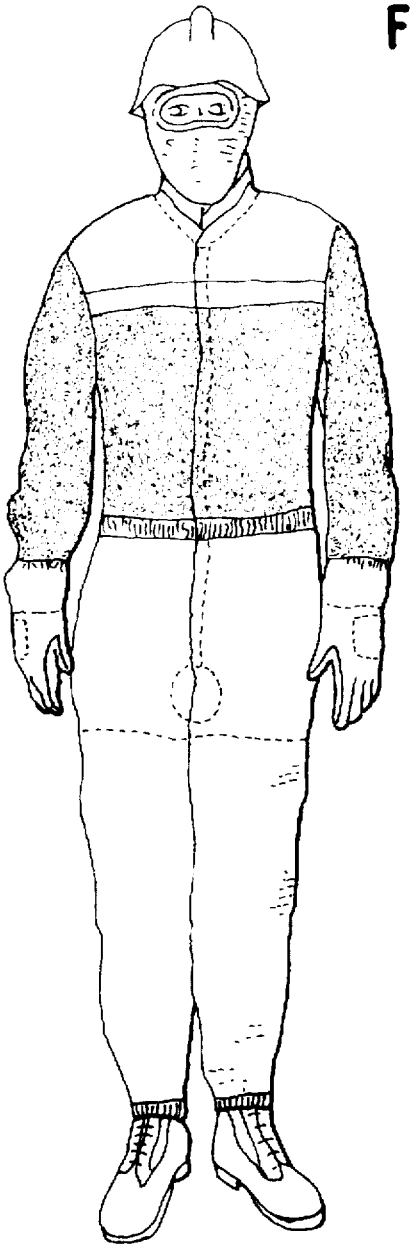
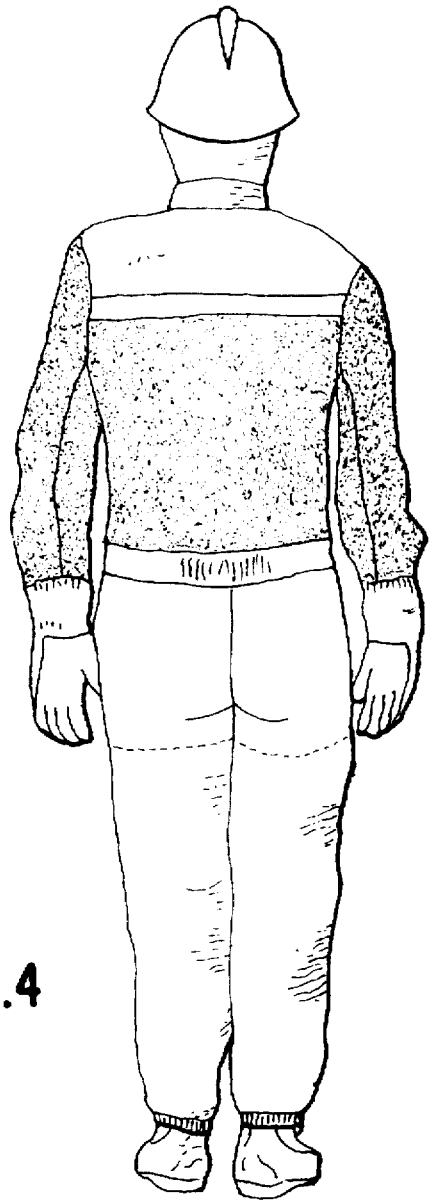
FIG. 4

FIG.5
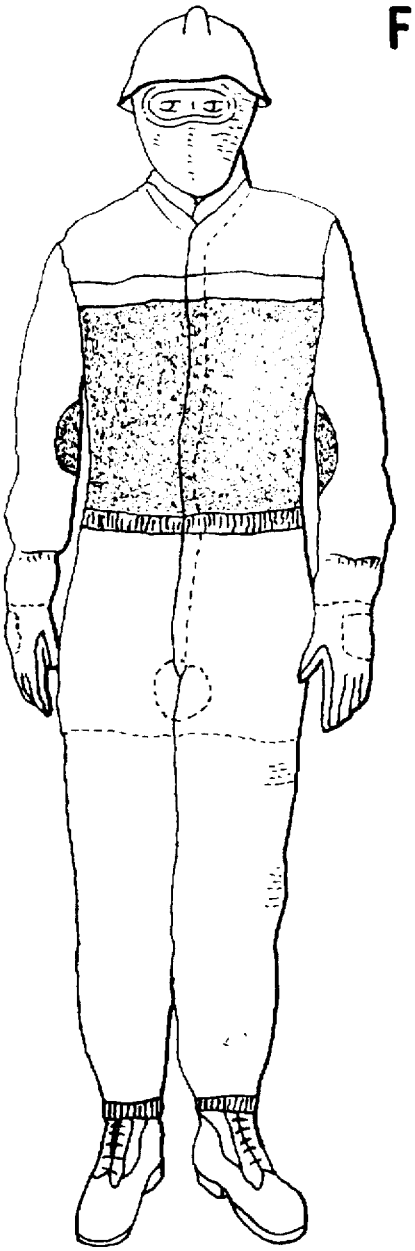
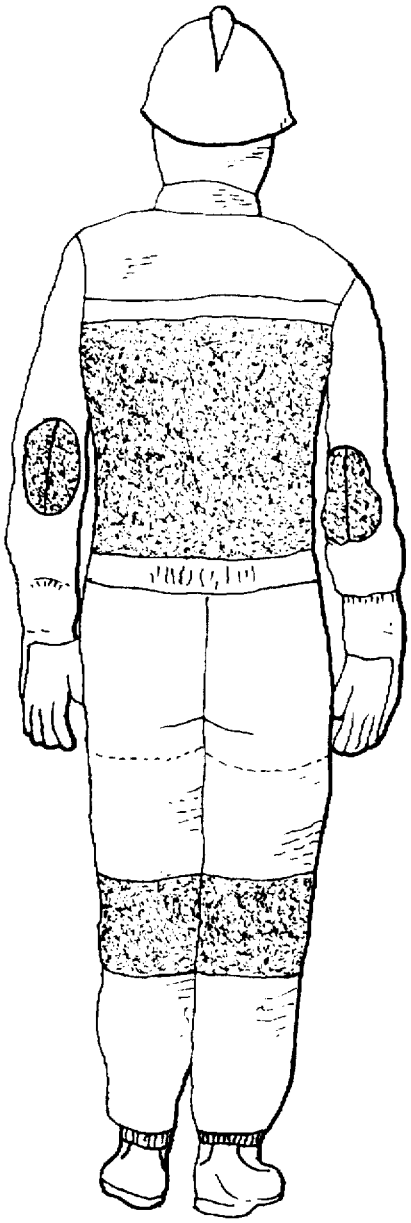
FIG.6

FIRE-PROOF PROTECTIVE WEARING OUTFITS WITH DIFFERENTIATED PERSPIRABILITY

This is a Continuation of application Ser. No. 08/311,000 filed on Sep. 22, 1994 now abandoned.

BACKGROUND OF THE INVENTION

The present invention relates to fire-proof protective wearing outfits for activities which involve a risk of burns, for example, urban, industrial and forest fire-fighting activities, as well as industrial activities which are carried out in the presence of molten metal, combustibles or high voltages, military and police activities, and for use by drivers of motor vehicles, aircraft pilots, as well as for sport activities and/or other heavy duties.

The invention results from studies and tests carried out by the Applicant in relation to the problem of safety in carrying out the activities identified above.

The Applicant has identified a set of basic principles (some of which are contrary to current technical thinking in this field) which must be satisfied in order to provide the best solution to the aforesaid problems and which have brought to the provision of a protective outfit forming the subject of Italian patent no. 1.238.868 and parallel U.S. Pat. No. 5,172,426 and European patent no. 433.991.

A first important principle, the identification of which forms the basis of the above identified previous patent, lies in that a safety outfit should be thought of as the combination of all the items of clothing which separate the skin of the person wearing the outfit from the outside environment. This finding had been previously completed ignored by designers in this sector. In fact, designers had always limited themselves to providing an outer protective covering for the person without paying attention to the undergarments.

A second important principle which also had always been ignored previously in the design of safety outfits, is the need to provide an outfit which is comfortable to wear and is tolerable throughout the period during which it is in use. In other words, comfort should be considered to be a safety factor, not only because an intolerable garment is not worn but also because the use of an outfit which is tiring to wear generally reduces the attentiveness of the person, whereas attentiveness is one of his main protections against accidents. Moreover, uncomfortable and heavy clothing which causes heavy perspiration helps to create the microclimatic conditions which favour heatstroke.

A further important consideration which should be taken into account in the design of safety outfits is that the classification of the seriousness of a burn depends not only—as it was thought previously—on the extent and depth of the burn (outfits known previously provided the same overall protection for all regions of the body) but, above all, on the part of the body which is damaged. Burns of even limited extent in functionally important regions of the body should be considered particularly serious both because they are difficult to cure and because of the incapacitating effects of their failure to recover.

Yet another basic principle lies in the fact that a protective garment should not nullify the main natural defence which consists of the ability of the skin to feel high temperatures and thus to detect danger. In other words, it is wrong to consider the protection of a person by the provision of an outfit which insulates him as much as possible from the outside environment. In fact, in such an outfit, the person may be in dangerous situation (for example, with a high ambient temperature) without realizing it until there is so much heat that it is transmitted through the outfit very quickly and burns the person before he can escape. It is therefore necessary to ensure that the interval between the reaching of the pain threshold and the reaching of the threshold of irreversible damage is always longer than the person's reaction time.

A protective outfit should have characteristics which makes it suitable for the specific situation in which it is used, that is, it should provide the intended protection to all regions of the body exposed to the risk.

Finally, the materials making up the outfit and its construction should of course be flame-proof.

In order simultaneously to satisfy all the requirements specified above, the Applicant has proposed in the above-mentioned previous patent a fire-proof protective outfit for activities involving a risk of burns, characterized by the following characteristics in combination:

a) the outfit is constituted by several garments which are at least partially superposed to provide different degrees of protection to different regions of the body of the person wearing the outfit, b) the outfit has a small area of minimum protection in correspondence with at least one more heat-resistant region of the body of the person wearing the outfit, constituting an area where the outside temperature can be detected so that the person can become aware of the ambient temperature promptly, c) in the regions of greatest protection, as a result of the superposition of the various garments, the outfit has an outer layer of fire-proof fabric superposed on at least one layer of mesh made of fire-proof yarn and at least one layer of net made of a fire-proof yarn, the layers being formed so as to facilitate the transfer of heat from the outside environment to the skin of the person wearing the outfit by radiation but to keep to a minimum the transfer of heat by conduction.

In particular, said outfit provides greater protection for the face, the hands, the flexing regions of the limbs, the wrists, the ankles and the perineum, that is, all the functionally important parts of the body. There is lesser protection for the volar regions of the limbs and the abdomen and, finally, even more limited protection for the remaining regions of the body. As already indicated above, these degrees of protection are achieved by superposition of the various garments making up the outfit.

The provision of an area where the ambient temperature can be detected allows the person never unknowingly to enter a dangerous zone. In fact, the first sensation of pain caused by the heat occurs soon enough to enable the person to react and escape before the burning threshold is reached.

The provision of the fabric, mesh and net layers described above to facilitate the transmission of heat by radiation means that, when the external temperature is high, the temperature of the skin always increases progressively. This ensures that, in any case, the skin temperature always takes a period longer than the person's reaction time to rise to the burning temperature.

SUMMARY OF THE INVENTION

The object of the present invention is that of further improving the previously proposed outfit in order to render it most suitable from the point of view of comfort, in view of its use for particularly heavy duties which may cause psycho-physical stress and the resulting need to dispose of the body heat produced through sweat evaporation. While proceeding in his researches with reference to the problem of operational comfort in particularly heavy duties, the Applicant has identified further important principles which have always been ignored either to in the design of protective outfits.

As indicated, in a protective outfit comfort is an essential element without which the protective and operativity features by themselves are no longer sufficient to ensure the necessary safety to the user. It can be stated that the absence of comfort represents the objective limit of a protective garment, which then can not be considered really protective since it can not be used by the user.

Comfort is the result of a number of features which must be simultaneously present in the outfit:

reduced weight, proper adherence to the body, suitability for being worn, studied in relation to the needs of mobility of the subject, in order that the latter is not prevented from carrying out his movements, air-permeability, suited to the needs of thermoregulation of the subject (sweat evaporation).

BRIEF DESCRIPTION OF THE DRAWINGS

Some examples of outfits according to the invention are shown in the annexed drawings, given purely by way of non limiting example, in which:

FIGS. 1 and 2 show a first embodiment of the outfit according to the invention, FIGS. 3 and 4 show a second embodiment of the outfit according to the invention, FIGS. 5 and 6 show a third embodiment of the outfit according to the invention.

DETAILED DESCRIPTION OF THE INVENTION

Figure 7:
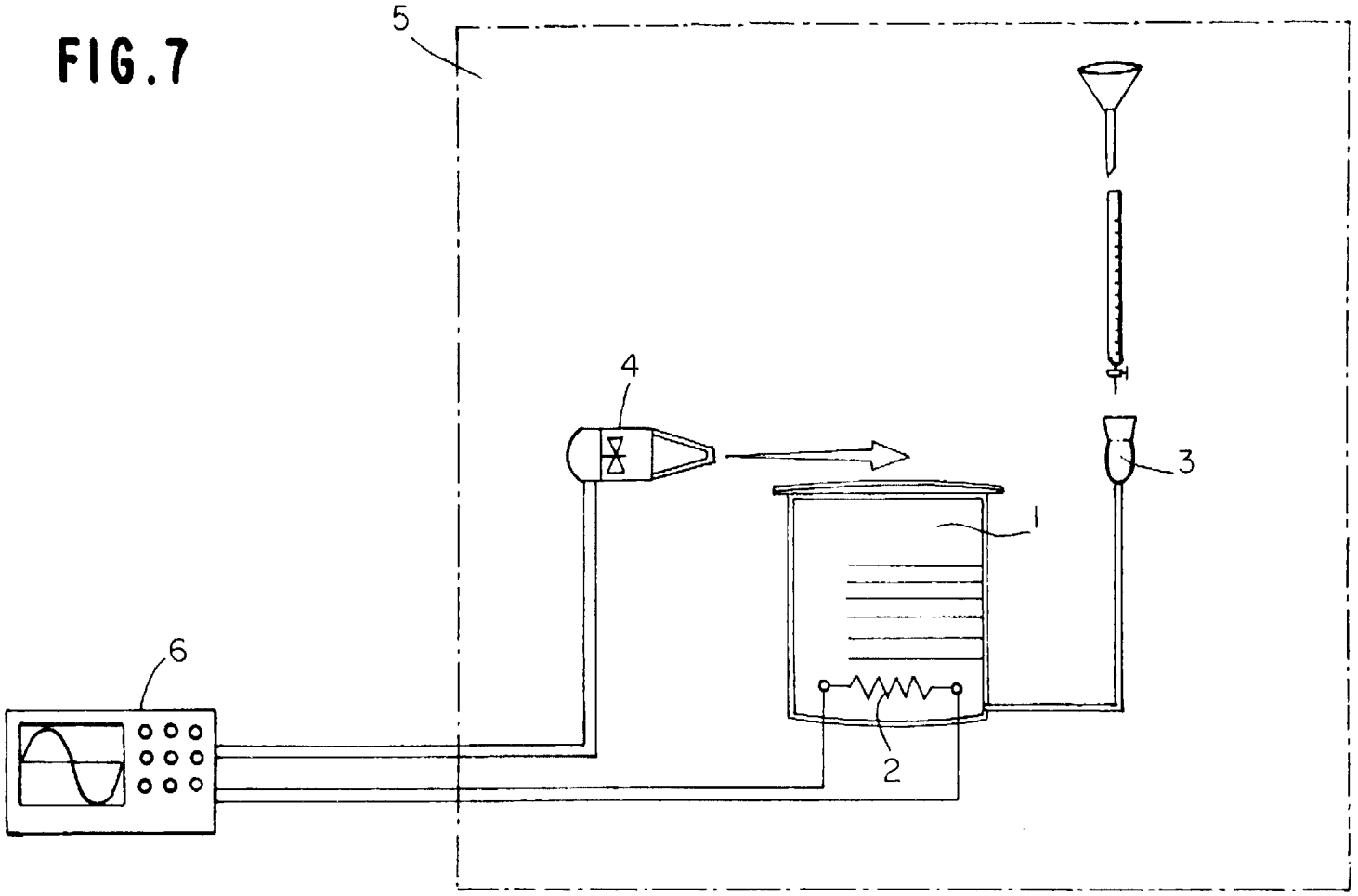
FIG. 7 shows the test apparatus used for designing the outfit according to the invention.

As to permeability, it must be stated firstly that to keep such feature at adequate levels in a protective outfit is not an easy task, particularly in tiring activities or in those activities which are carried out in hot climates or, also, which involve anxiety or psychic stress. In fact if, as normally is the case, the insulation is obtained by using thick layers of insulating materials, an obstacle to sweat evaporation will be created.

In order to understand this problem, some essential aspects of the phenomenon of sweating must be considered.

At rest and with room temperatures not greater than 25° C., a portion (about 25%) of the heat of the human body is discharged by the lungs and the skin in form of vapour, by osmosis and without affecting the sudoriparous glands. This phenomenon, known as "perspiratio insensibilis" is greatly different from what happens at higher temperatures and, above all, in relation to the physical activity of the subject. In this second case, other cooling mechanisms begin to operate: conduction, radiation, convection and evaporation. If the ambient temperature raises over 35° C., the heat dissipation is assigned to this latter process. But also when the climatic conditions allow heat dissipation by convection and radiation, the dissipation of the heat produced by a heavy muscle activity is anyway assigned for 70% to evaporation of sweat.

Therefore there is a substantial difference between the discharges of "perspiratio insensibilis", in which cooling of the body takes place directly in form of vapour, and those of sweating. In this latter case liquid sweat, in form of microdrops, is emitted by the sudoriparous glands, such emission being effective for body thermoregulation when there are ambient conditions suitable to evaporation thereof.

In a subject who wears an outfit, the sweat evaporation takes place only provided that the space between the skin and the outfit has temperature, relative humidity and air speed values which are favourable. If this is not the case, the evaporation does not take place and the phenomenon of "profuse sweat" will be observed, that is the flow on the surface of the body of sweat which is not evaporated and brings the subject to a progressive dehydration, with no effect on the thermoregulation. Hyperthermia will then be originated, which may involve detrimental consequences for the subject. For example, a subject weighing 65 Kg. who carries out a light job at an ambient temperature of 29° C., is able to produce as an average 2–3 liters of sweat during 24 hours. The situation dramatically changes if the subject carries out a heavy job, since sweating may reach maximum values of 2–4 liters per hour, even if for short intervals.

Considering an intermediate situation, we may think of a situation of 1 liter/hour of sweat which allows when evaporated, a dissipation of about 600 Kcal. This is possible only if the outfit with which the individual is equipped allows for the total evaporation of the sweat produced. If this is not the case, an accumulation of 77 Kcal/$m^2$ of surface of the body would cause a rise in the body temperature of about 2° C., with the resulting detrimental consequences.

A further important principle on which the present invention is based, and which also has been ignored by designers of protective outfits, lies in that the sweating phenomenon takes place with different ways and intensities in relation to the difference of stimulations and in that there are anyway skin regions which, because of a greater concentration of glands, are able to produce higher quantities of sweat. In the case of a muscle activity with copious sweating, the regions with greater production are those which are more exposed, that is those which offer the best conditions for evaporation. Thus, the greater portion of the total sweat is given by the trunk, and the remaining portion by the head, the upper limbs and the lower limbs. For example, a subject who is 170 cm tall and weighs 70 Kg, engaged during one hour in a job at a blast furnace of a steel plant must be able to dissipate the following evaporated sweat through his outfit in order to keep a thermal balance: 52 g from the head, 104 g from the arms, 37 g from the hands, 37 g from the feet, 68 g from the legs, 89 g from the thighs, 388 g from the trunk.

Starting from the above consideration, the Applicant has come to provide the protective outfit according to the invention. This outfit has all the features which have formed the subject of the previous patent of the Applicant which has been mentioned above and is further characterized in that the various garment components by which it is formed are configured, constituted and arranged in such a way as to provide a different degree of air-permeability in different regions of the outfit.

In particular, the regions of the outfit which are to be located at the regions of the body with higher sweating will have a greater permeability. The position and extension of these zones depends of course also upon the particular activity to which the outfit is directed.

It must be stressed that the concept discussed herein relating to the provision of an outfit with regions having different air-permeability has nothing to do with the other aspect which has formed the subject of the previous patent of the Applicant, relating to the provision of an outfit with regions adapted to provide a different degree of protection against burns. In other words, a garment portion which provides a greater protection against burns is not necessarily less pervious to air and viceversa.

The Applicant has also identified a particularly advantageous method for designing the outfit according to the invention. This method includes five subsequent steps.

Step 1 - analysis of ambient and operational conditions

In this step, the operational conditions which are typical for the activity under examination are analyzed: in this regard, all the movements and the positions which the operators assume while performing their task are observed and recorded; the collected material (usually represented by video recordings) is examined while paying particular attention to recurrent movements and "extreme" positions which are assumed.

By a suitable monitoring systems, on a sample of operators in activity there are recorded the parameters indicating a psycho-physical stress (microclimate within the outfit, sub-lingual body temperature, heart pulse). At the same time, the climatic parameters typical of the ambient of operation are recorded: temperature and air relative humidity, speed of air currents, radiating temperatures. Furthermore, during this step, the features and the structure of the ambient of operation are examined, particularly for activities which are carried out in closed or small rooms.

Step 2 - energy waste and determination of the volume of sweat produced

The Applicant has implemented a computerized calculation system which provides a relation between the energy waste due to a specific activity which is carried out by the operator and the sweat amount which is produced at any body region. On the basis of the results of this calculation, it is possible to identify which body regions need more perspiration and to determine which material must be used for each of these regions when manufacturing the outfit.

For example in the case of a forest fire fighting activity, with a subject weighing 70 Kg and 170 cm tall an energy waste of 360 Kcal/hour takes place with a production of heat of 270 Kcal/hour and a production of sweat of 466 g/hour. The following table shows for each body zone, the value of the body surface which is affected by perspiration, the quantity/g/hour of sweat produced and the Minimum Requested Perspirability (MRP), indicated by $g/m^2/hour$:

| BODY REGION | SURFACE ($cm^2$) | SWEATING (g/hour) | PERSPIRABILITY MRP ($g/m^2/hour$) |
|---|---|---|---|
| HEAD | 1267 | 31 | 247 |
| TRUNK | 6696 | 233 | 348 |
| ARMS | 2534 | 63 | 247 |
| HANDS | 905 | 22 | 247 |
| THIGHS | 3077 | 53 | 174 |
| LEGS | 2353 | 41 | 174 |
| FEET | 1267 | 22 | 174 |

Step 3 - identification of materials suitable to ensure adequate perspirability of the outfit In this step the materials suitable to prove the protective outfit for the specific activity are identified.

Figure 8:
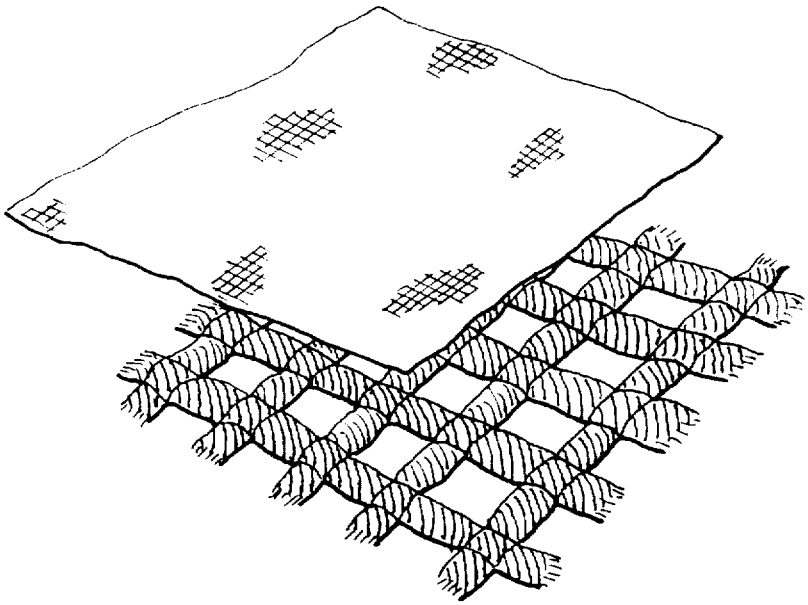
FIG. 8 is a partial exploded view of a liner for the outfit.

The characteristics of the materials, with regard to protection of the operator from the risk of burns are described in the above-mentioned previous patent of the Applicant. In particular, as to the provision of different layers including an outer layer of fire-proof fabric, a layer of fire-proof mesh and a net of a fire-proof yarn, such arrangements are disclosed in FIGS. 17–21 of the previous patent which has been identified above and in the corresponding portions of the description. An example is shown in FIG. 8 wherein a layer of mesh made of fire-proof yarn is superimposed in a layer of net of fire-proof yarn to define a lining.

While such features are kept, the materials are chosen through the evaluation of air-perspirability. For determination of the latter, the Applicant has devised an apparatus which will be described in detail hereinafter. Each material, when tested by this apparatus simulating the operative situation, shows perspirability characteristic values which may be compared with the results obtained through the computerized program of step 2.

Step 4 - definition of the structure and embodiment of the outfit

In this step design of the outfit is carried out according to the protection and comfort requirements; the design principles relating to protection are those already disclosed in the previous patent of the Applicant which has been identified above. Comfort of the outfit is determined and provided on the basis of the data obtained in the above described steps 1, 2 and 3.

The emdodiment of the outfit is an immediate result of the examined operational movements and the structure of the outfit is determined by the arrangement of the chosen materials to provide a differentiated air perspirability.

For each body region protected by the outfit, materials provided with air perspirability and features suitable to dissipation of the heat produced by evaporation of sweat are used: the body regions with greater sweating are covered by outfit portions made of materials with high air-permeability; the other body regions, in which sweating is more reduced, are covered by outfit portions made of materials provided with lower permeability, suitable however to ensure evaporation of the sweat produced in these zones.

Step 5 - practical tests

The outfit thus made is tested in an operative situation identical to that examined in step 1, firstly through a simulation in a climatic chamber of the ambient and activity parameters and subsequently in an actual situation. By monitoring the parameters indicating stress and comparing same with the values obtained in step 1, the efficiency of the outfit made on the basis of the principles of the invention is evaluated.

FIGS. 1–6 show only the outer portion of the outfit according to the invention. However, it is stressed that the structure of these outfits includes different components superposed on each other, exactly as illustrated in the previous patent of the Applicant which has been identified above. The annexed drawings are intended only to show the fact that the outfits according to the invention have different regions with different air-permeability. The regions with greater permeability are those shown as being darker. The outfit of FIGS. 1, 2 is intended for metallurgical activities, that of FIGS. 3, 4 for forest, urban and industrial fire-fighting activities and that of FIGS. 5, 6 also for fire-fighting activities.

As indicated above, the outfit may include a plurality of garment components partially superposed on each other; the differentiated permeability must be provided through the superposed materials of each of the garments provided in the outfit, where by "outfit" all the materials which separate the skin of the operator from the outer environment is meant.

FIG. 7 shows a test apparatus which is for measuring the permeability of materials. It comprises a container 1 which can be brought to physiological temperature by a heating resistance 2 controlled by a thermostat. Within container 1 there is introduced a known amount of liquid having a salt composition similar to that of human sweat. Reference numeral 3 designates a system of communicated vessels, connected to container 1, which keeps the level of liquid of container 1 constant notwithstanding the evaporation of the liquid as a result of heating. The liquid amount which must be introduced to keep the level within container 1 constant obviously corresponds to the amount of evaporated liquid. Reference numeral 4 designates a ventilation system to supply an air current on the surface of the fabric sample, which is arranged horizontally, so as to close container 1 at its top; ventilation system 4 is intended to simulate the air current present in the actual operative environment. All the said components are arranged within a climatic chamber 5, which allows for simulation of all the climatic parameters observed in the operative condition, in any season (temperature and relative humidity of air, any radiant temperature, etc.).

A control electronic unit 6 is connected to the electric resistance 2 and the ventilation system 4.

As mentioned above, by this apparatus it is possible to test various materials (fabrics) and evaluate their air-permeability characteristic (see above-mentioned Step 3) to be compared with the results of the above described Step 2, in order to match each body region with an outfit portion having the necessary perspirability.

Naturally, while the principle of the invention remains the same, the details of construction and the embodiments may widely vary with respect to what has been described and illustrated purely by way of example, without departing from the scope of the present invention.

I claim:

1. The protective fire-proof outfit for activities involving a risk of burns, having the following characteristics, in combination:

a) the outfit being constituted of various garment components which are at least partially superposed on each other so as to provide a different degree of protection for different body regions of a person wearing the outfit, b) the outfit having a small area of minimum protection in correspondence with at least one more heat-resistant body region of a person wearing the outfit, constituting an area where the ambient temperature of an environment outside the outfit can be detected so that a person can become aware of the ambient temperature promptly, c) in regions of greatest protection, as a result of the superposition of the various garment components, the outfit has an outer layer of fire-proof fabric superposed on at least one layer of mesh made of a fire-proof yarn and at least one layer of net made of fire-proof yarn, the layers being arranged so as to facilitate the transfer of heat from the outside environment to the skin of a person wearing the outfit by radiation but to keep to a minimum the transfer of heat by conduction, wherein the garment components of which the outfit is made are configured to provide a different degree of air-permeability in different regions of the outfit, wherein said outfit includes a portion of greater air-permeability comprising at least a horizontal strip-like portion extending substantially through half of the height of a portion of the outfit designed to cover a wearer's trunk, below a line which is spaced apart downwardly from a portion of the outfit designed to be worn adjacent a wearer's shoulders, so as to cover the breast and central area of the back of a wearer, wherein the portion of greater air permeability also covers the region of a wearer's trunk below said strip-like portion, and wherein the portion of greater air permeability also covers a portion of the outfit designed to cover the entirety of a wearer's arms.

* * * * *